US008075236B2

(12) United States Patent
Penne

(10) Patent No.: US 8,075,236 B2
(45) Date of Patent: Dec. 13, 2011

(54) METHOD FOR BINDING A QUIRE AND DEVICE APPLIED THEREBY

(76) Inventor: Stefaan Penne, Hofstade (BE)

( * ) Notice: Subject to any disclaimer, the term of this patent is extended or adjusted under 35 U.S.C. 154(b) by 806 days.

(21) Appl. No.: 10/585,935

(22) PCT Filed: Jan. 21, 2005

(86) PCT No.: PCT/BE2005/000007

§ 371 (c)(1),
(2), (4) Date: Jul. 13, 2006

(87) PCT Pub. No.: WO2005/072943

PCT Pub. Date: Aug. 11, 2005

(65) Prior Publication Data

US 2007/0161485 A1 Jul. 12, 2007

(30) Foreign Application Priority Data

Jan. 29, 2004 (BE) ..... 2004/0046

(51) Int. Cl.

| | |
|---|---|
| ***B42C 9/00*** | (2006.01) |
| ***B42B 5/08*** | (2006.01) |
| ***B26D 7/14*** | (2006.01) |
| ***B31B 1/14*** | (2006.01) |
| ***B31B 49/00*** | (2006.01) |
| ***B31F 5/02*** | (2006.01) |
| ***B31F 7/00*** | (2006.01) |

(52) U.S. Cl. ..... 412/6; 412/7; 83/20; 83/21; 83/176; 493/351; 493/390

(58) Field of Classification Search ..... 281/26; 493/150, 151, 390, 391, 392, 352, 353, 346; 83/916, 20, 21, 176; 412/6, 7; D19/72
See application file for complete search history.

(56) References Cited

U.S. PATENT DOCUMENTS

| | | | | | |
|---|---|---|---|---|---|
| 766,905 | A | * | 8/1904 | Ruth | 493/351 |
| 1,324,103 | A | * | 12/1919 | Cone | 493/351 |
| 1,765,194 | A | * | 6/1930 | Von Auw | 281/21.1 |
| 1,932,153 | A | * | 10/1933 | Bergendahl | 412/6 |
| 2,016,052 | A | * | 10/1935 | Roeder | 493/356 |
| 2,587,749 | A | * | 3/1952 | Misson | 83/627 |
| 2,749,816 | A | * | 6/1956 | Jewell | 493/390 |
| 3,005,371 | A | * | 10/1961 | Misson | 83/549 |
| 4,364,737 | A | | 12/1982 | Sowden | |
| 4,833,958 | A | * | 5/1989 | Abildgaard et al. | 83/154 |
| 5,447,402 | A | * | 9/1995 | Kobayashi | 493/351 |
| 5,899,841 | A | * | 5/1999 | Berger | 493/351 |
| 2002/0020272 | A1 | * | 2/2002 | Godston et al. | 83/620 |
| 2007/0116542 | A1 | * | 5/2007 | Trovinger | 412/1 |

FOREIGN PATENT DOCUMENTS

| | | | |
|---|---|---|---|
| CN | 1100369 | A | 3/1995 |
| CN | 2294162 | Y | 10/1998 |

(Continued)

*Primary Examiner* — Dana Ross
*Assistant Examiner* — Kyle Grabowski
(74) *Attorney, Agent, or Firm* — Bacon & Thomas, PLLC

(57) ABSTRACT

Method for binding a quire formed of folded sheets slipped into each other, characterized in that it consists in providing at least one cut through the sheets of the quire as of a short distance from the folding edge of the quire, whereby every cut through a sheet of the quire defines a lip extending mainly crosswise to the above-mentioned folding edge of the quire and which is connected to the quire with its far end turned towards the folding edge, and whereby said lip has a widening.

8 Claims, 4 Drawing Sheets

FOREIGN PATENT DOCUMENTS

| | | |
|---|---|---|
| CN | 2393715 Y | 8/2000 |
| EP | 0 015 717 | 9/1980 |
| EP | 0 362 046 | 4/1990 |
| GB | 390586 | 4/1933 |

* cited by examiner

METHOD FOR BINDING A QUIRE AND DEVICE APPLIED THEREBY

The present invention concerns a method for binding a quire, more particularly a quire consisting of several double-folded sheets of paper, cardboard, plastic, metal foil or the like, for example for newspapers, periodicals, packings and the like. For simplicity's sake, the term sheets will always be used in what follows, by which all sorts of sheets of paper, plastic, metal foil or the like are meant.

It is known that quires of periodicals or the like are usually bound by means of stapling or the like, which is relatively expensive and whereby the presence of such staples makes recycling more difficult.

It is also known that quires of newspapers are not bound at all, which makes reading papers more difficult, since when opening the paper or when folding it over, the loose pages can shift in relation to each other, as a result of which it is difficult to fold and read a newspaper in a neat manner.

The present invention aims to remedy these and other disadvantages by providing a method which makes it possible to bind quires in a simple and efficient manner without using any additional binding materials, simply by providing cuts in an appropriate form.

To this end, the invention concerns a method for binding a quire formed of folded sheets slipped into each other, characterised in that it consists in providing at least one cut through the sheets of the quire as of a short distance from the folding edge of the quire, whereby every cut through a sheet of the quire defines a lip extending mainly crosswise to the above-mentioned folding edge of the quire and which is connected to the quire with its far ends turned towards the folding edge, and whereby said lip has a widening at a distance from said far end.

An advantage of this method according to the invention is that the quire can be bound without applying any materials which are not characteristic of the quire, such as staples or the like, such that the quire can be recycled relatively easily.

Moreover, binding a quire by means of a method according to the invention requires only a relatively simple operation, which can be carried out in a relatively cheap manner.

The present invention also concerns a device which can be applied with the above-described method, which device consists of a table and at least one cutting means which makes it possible to make at least one cut in the different sheets of the quire, in order to form a lip.

This device according to the invention is relatively simple and, as a consequence, can be manufactured in a relatively cheap manner, which offers the advantage that binding a quire by means of the method and device according to the invention entails only minimal costs.

In order to better explain the characteristics of the invention, the following preferred applications of a method and device according to the invention for binding a quire are described as an example only without being limitative in any way, with reference to the accompanying drawings, in which:

FIG. 1 schematically represents a device according to the invention while in use;

Figure 2:
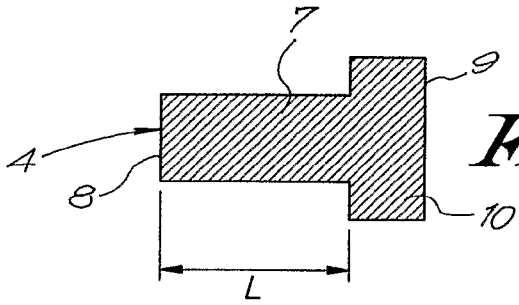
FIG. 2 represents a section according to line II-II in FIG. 1.
Figure 3:
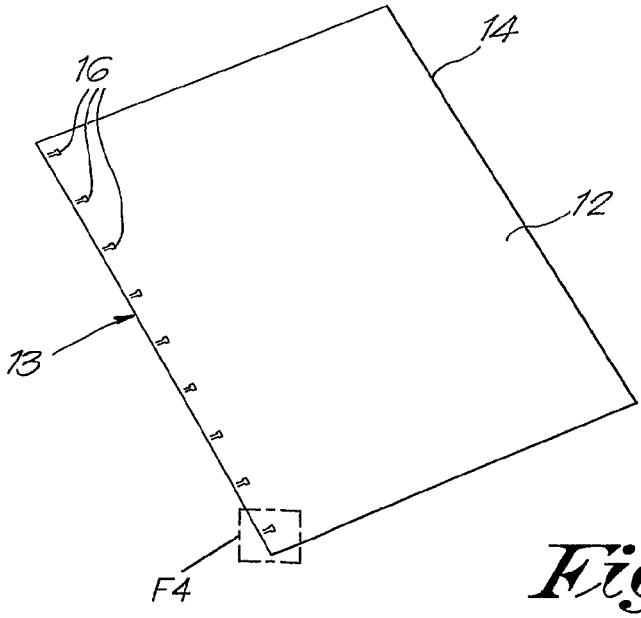
FIG. 3 represents a quire to a smaller scale and in perspective, which is bound by means of a method according to the invention.
Figure 4:
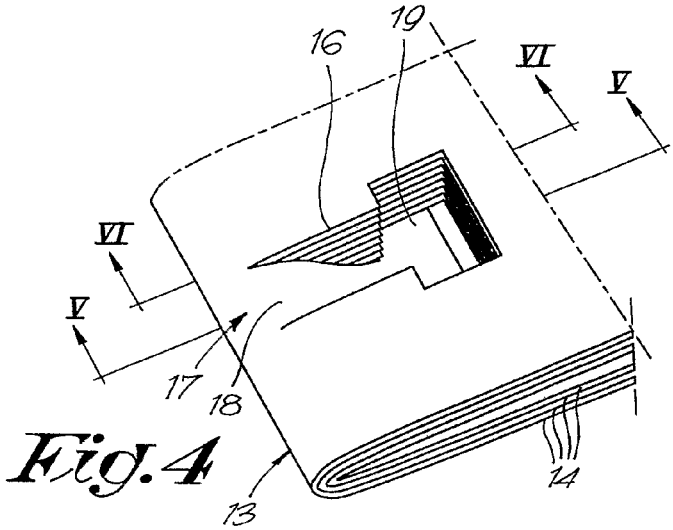
FIG. 4 represents a part which is indicated by F4 in FIG. 3 to a larger scale.
Figure 5:
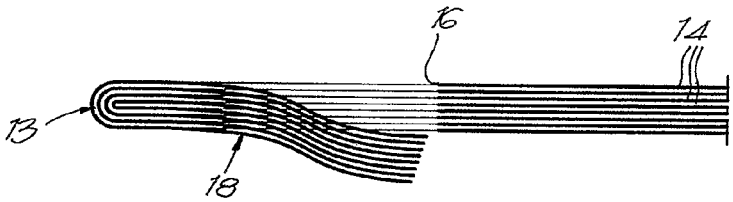
FIG. 5 represents a section according to line V-V in FIG. 4.
Figure 6:
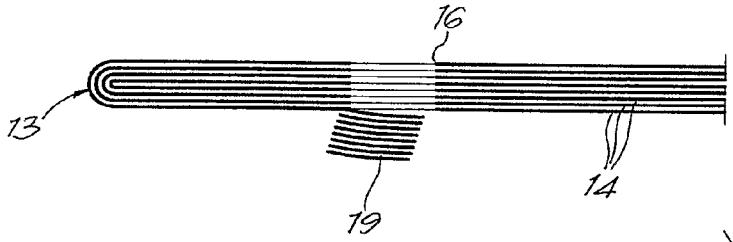
FIG. 6 represents a section according to line VI-VI in FIG. 4.
Figure 7:
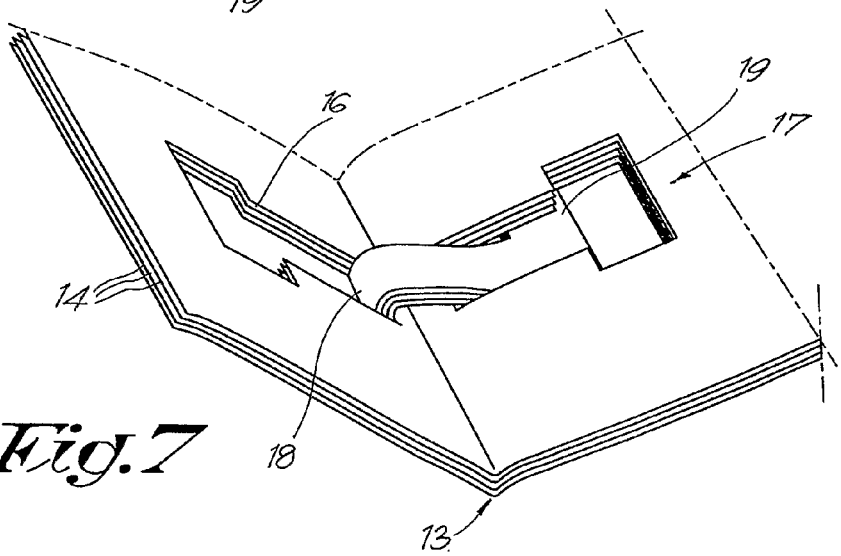
FIG. 7 represents the same part as in FIG. 4, but when unfolded.

FIGS. 12 to 16 each represent possible variants of a section according to FIG. 2.

Figure 1:
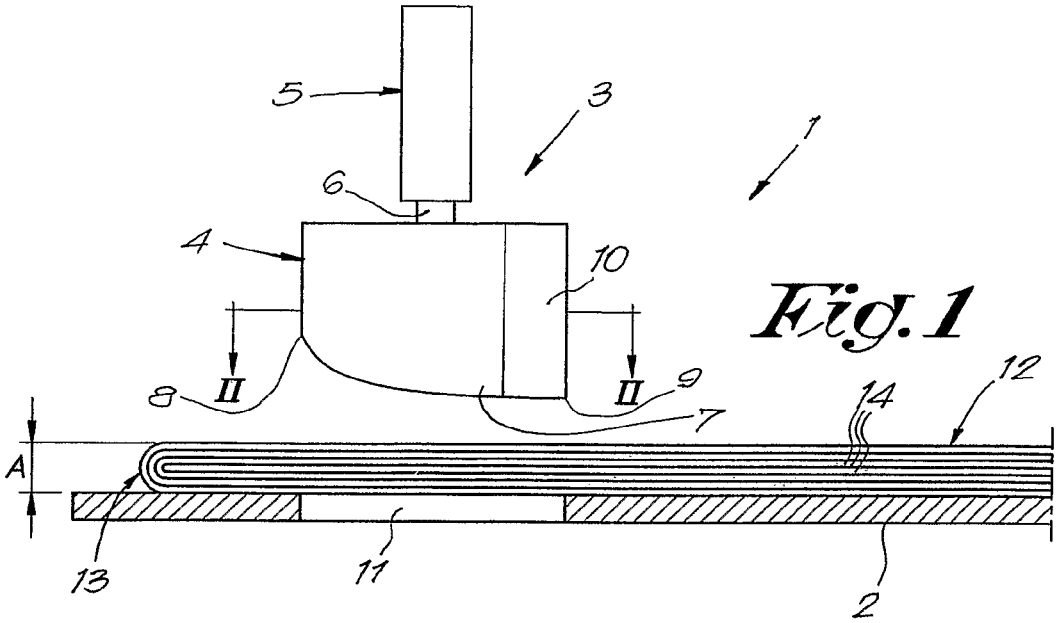

FIG. 1 schematically represents a device 1 according to the invention which mainly consists of a table 2 and of a cutting means 3.

In the represented embodiment, the cutting means 3 is formed of a die 4 onto which is provided, in this case, a cylinder 5, with its piston rod 6, which piston rod 6 can be axially moved, and which cylinder 5 is provided with an excitation not represented in the figures.

The die 4 is made in the form of a profiled knife 7, one cutting edge 8 of which is situated in the axial direction of movement of the cylinder 5, at a larger distance from the table 2 than the opposite cutting edge 9 concerned.

FIG. 2 represents a cross section of the die 4, represented in relation to its axial direction of movement, whereby the die has a widening 10 at a distance L from its above-mentioned cutting edge 8.

In the table 2 has been provided a recess 11, whose shape corresponds to the contour form of the knife 7.

The use of the device 1 according to the invention is very simple and as follows.

As is represented in FIG. 1, a quire 12 to be bound is placed on the table 2 as folded, such that the folding edge 13 of the sheets 14 of the quire 12 is positioned at a relatively short distance from the recess 11 in the table 2. To this end, the table 2 can be provided with a stop 15.

In order to bind the quire 12, the die 4 is axially moved, in this case, by pushing out the piston rod 6 of the above-mentioned cylinder 5, whereby the profiled knife 7 is partly moved through the recess 11, while making sure that the above-mentioned cutting edge 8 of the knife 7, is situated closest to the folding edge 13 of the quire 12 and does not cut the sheets 14 of the quire 12, as a result of which a cut 16 is provided in the sheets 14 of the quire 12.

Thanks to this cut 16, a lip 17 is formed in each of the sheets 14 of the quire 12 which extends mainly crosswise to the above-mentioned folding edge and which is connected to the quire 12 with its far end 18 turned towards the folding edge 13, and whereby this lip 17 has a widening 19 at a distance from said far end 18, for example in the shape of a T-shaped lip 17.

Next, the lips 17 of each sheet 14 are pushed through the cuts 16 in the underlying sheets 14 of the quire 12, whereby, as is represented in FIGS. 4 to 7, the widenings 19 of the different lips 17 mesh under the side edges of the cut 16 in the back sheet 14 of the quire 12, as a result of which the sheets 14 of the quire 12 are kept in place in relation to each other and as a result of which the quire 12 can always be folded back easily along its original folding edge 13.

Figure 8:
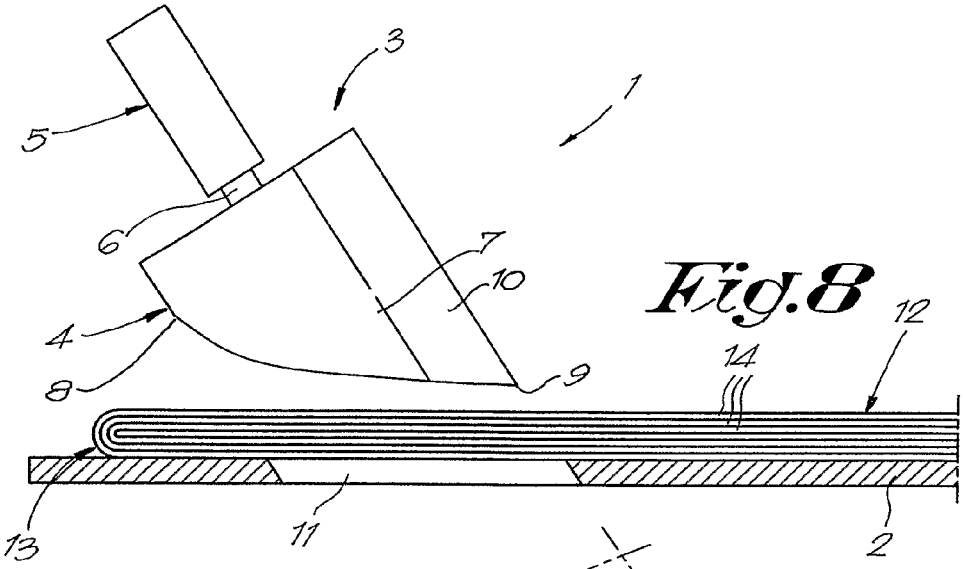
FIG. 8 represents a variant of FIG. 1.

FIG. 8 represents a variant of the device 1 according to the invention, whereby the cutting means 3 is directed slantingly in relation to the table 2.

Figure 9:
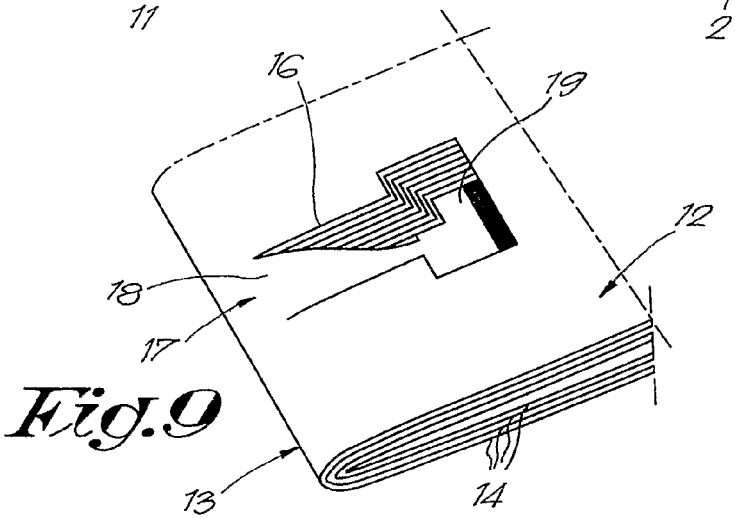
FIG. 9 represents the same part as in FIG. 4, but of a quire bound with the help of a device as represented in FIG. 8.

According to this variant, a cut 16 can be provided in the different sheets 14 of the quire 12, whereby the position of the cuts 16 through the successive sheets 14 is removed always further away from the folding edge 13, which is advantageous in that the widenings 19 of the different lips 17 mesh further under the side edges of the cut 16 in the back sheet 14, as is represented in FIG. 9.

Figure 10:
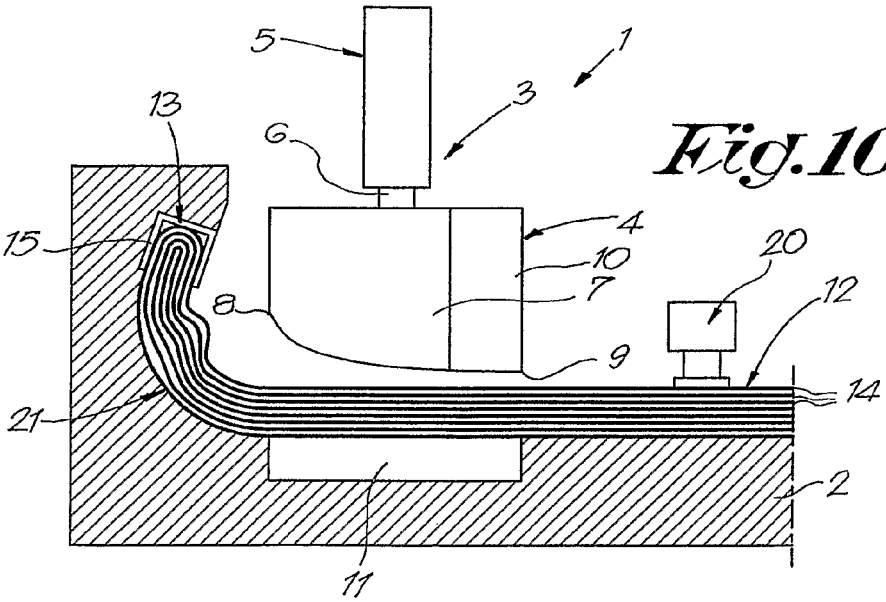
FIGS. 10 and 11 represent variants of FIG. 1.
Figure 11:
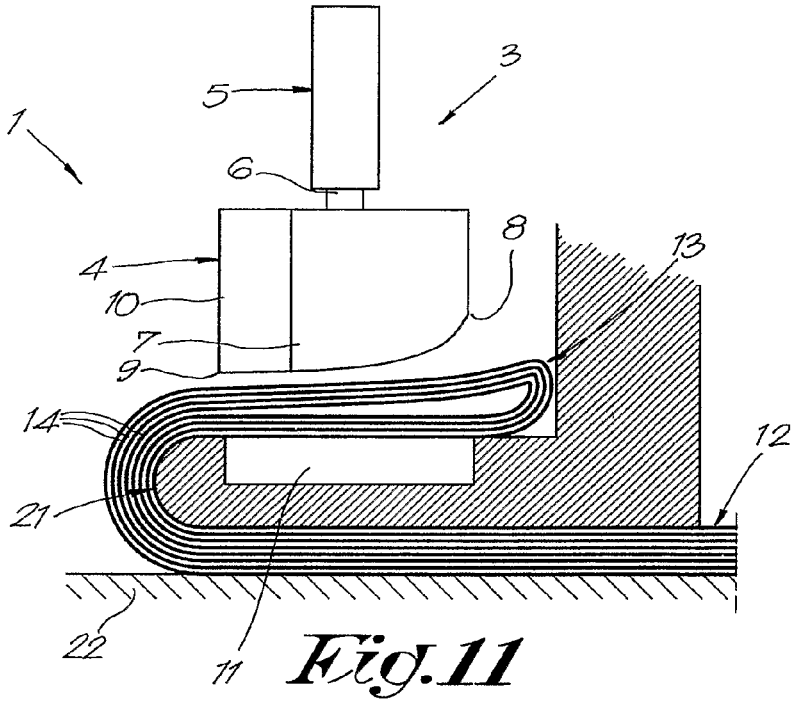
Figure 12:
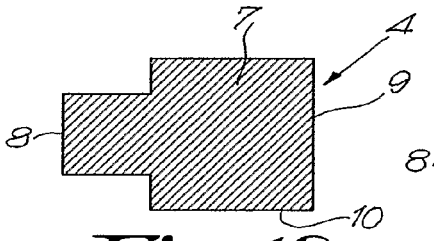
Figure 13:
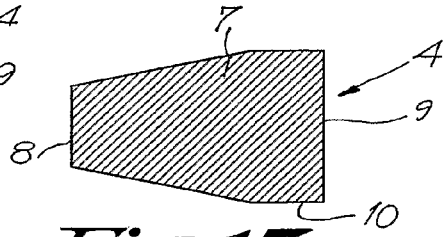
Figure 14:
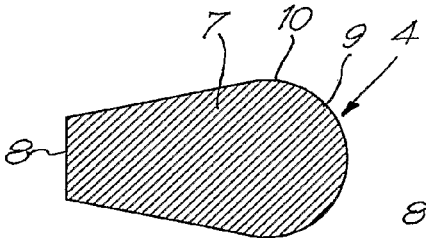
Figure 15:
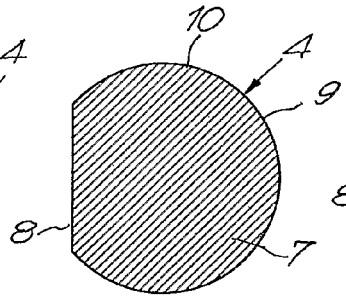
Figure 16:
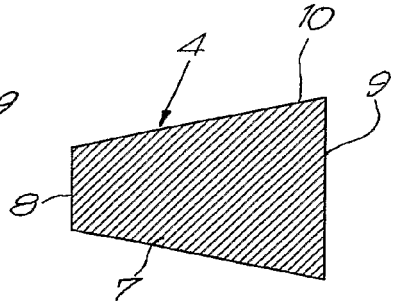

In FIGS. 10 and 11 is each time applied a bowed table 2, such that the sheets 14 of a quire 12, provided on one of these tables 2', are partly rolled up, such that the successive sheets 12 are shifted in relation to each other at the height of the recess 11 in the table 2 concerned. When a cut 16 is provided in this case, crosswise to the surface of the quire 12, the cuts 16 in successive sheets 14 of the quire 12 will have shifted a little in relation to each other, as a result of which the same effect is obtained as in the above-described variant represented in FIG. 8.

As represented in FIG. 10, it is possible to provide clamping means 20 on the table 2, which clamping means 20 make it possible to clamp the sheets 14 of the quire 12 together. Such clamping means 20 are useful when, on a bowed table 2, a cut 16 through the sheets 14 of a quire 12 is aimed which is situated in all the sheets 14 at an equal, or almost equal distance from the folding edge 13.

In this case, the quire 2 must be placed flat on the table 2 first, after which the clamping means 20 are provided. Next, the quire 12 can be folded over the bowed part 21 of the table 2, such that the underlying displacement of the sheets 14 is situated between the folding edge 13 and the place of the cut 16.

When using the device 1, which is schematically represented in FIG. 11, the sheets 14 of the quire 12 are clamped between the table 2 and a supporting area 21, and then they are folded back up to under the cutting means 3.

By folding the sheets 14 of the quire 12, the folding edge 13 is lifted somewhat from the table 2, such that the distance between the folding edge 13 and the place where the cut 16 will be provided is smaller for the sheets 14 lying on top than for the underlying sheets 14 of the quire 12. After the above-mentioned cut 16 has been provided and the formed lips 17 have been pushed through, the lips 17 of the sheets 14 lying on top will mesh, as a result, relatively far behind the side edges of the cut 16 into the bottom sheet 14 of the quire 12.

FIGS. 12 to 16 represent various possible cross sections of knives 7 which can be applied to provide a cut 16 according to the invention.

What is important hereby is that these sections all represent a form, whose widening 10 is situated at a length L from the above-mentioned cutting edge 8, whereby the value of L is larger than the value A, which is a measure for the thickness of the quire 12 to be bound.

Naturally, it is not necessary, in the above-described embodiments, to apply an excited cylinder 5 in order to move the knife 7. This movement can be obtained with other means as well, for example by means of a pressure mechanism similar to that of a conventional paper perforator.

It should be noted that the cutting means 3 must not necessarily be a die 4, but that it is also possible to provide the above-described cuts 16 by means of a laser or the like.

The present invention is by no means limited to the above-described embodiments represented in the accompanying drawings; on the contrary, such a method and device for binding a quire can be made according to different variants while still remaining within the scope of the invention.

The invention claimed is:

1. Method for binding a quire formed of folded sheets slipped into each other, comprising:

providing a quire formed of folded sheets slipped into each other;

at least partly rolling up the quire along the folding edge of the quire; and providing at least one cut through the sheets of the quire as of a short distance from the folding edge of the quire, wherein every cut through a sheet of the quire defines a lip extending mainly crosswise to the folding edge of the quire and which is connected to the quire with its far end turned towards the folding edge, and wherein said lip has a widening.

2. Method according to claim 1, wherein the widening is situated at a distance from the far end of the lip turned towards the folding edge.

3. Method according to claim 1, wherein the lip is made T-shaped.

4. Method according to claim 1, wherein the cut through the quire is provided slantingly in relation to the surface of the quire.

5. Method according to claim 1, wherein the cut is realised by means of a profiled die which is partly pushed through the quire.

6. Method according to claim 5, wherein the die is pushed partly through the quire, slantingly in relation to the quire.

7. Method according to claim 1, wherein several cuts are provided at the same distance from the folding edge of the quire, at mutual distances from each other.

8. Method according to claim 1, wherein the lips are pushed through, as a result of which all the lips mesh under the bottom sheet of the quire.

* * * * *